United States Patent [19]

Saenger et al.

[11] 4,144,663

[45] Mar. 20, 1979

[54] SWITCHABLE SIGN

[75] Inventors: Leif H. Saenger; Per R. Danielsen, both of Halden, Norway

[73] Assignee: Norlux A/S, Halden, Norway

[21] Appl. No.: 786,360

[22] Filed: Apr. 11, 1977

Related U.S. Application Data

[63] Continuation-in-part of Ser. No. 629,068, Nov. 5, 1975, abandoned.

[30] Foreign Application Priority Data

Nov. 6, 1974 [NO] Norway ..... 743993

[51] Int. Cl.[2] ..... G09F 13/24

[52] U.S. Cl. ..... 40/406

[58] Field of Search ..... 40/106.21, 106.22, 37, 40/406, 407

[56] References Cited

U.S. PATENT DOCUMENTS

| | | | |
|---|---|---|---|
| 913,022 | 2/1909 | Marsh | 40/106.21 |
| 1,782,328 | 11/1930 | Wearham | 40/106.21 X |
| 1,887,285 | 11/1932 | Burrell et al. | 40/106.21 |
| 3,388,490 | 6/1968 | Stechemesser | 40/106.21 |
| 3,638,342 | 2/1972 | Winslow et al. | 40/106.21 |

FOREIGN PATENT DOCUMENTS

| | | | |
|---|---|---|---|
| 312105 | 5/1929 | United Kingdom | 40/106.22 |

OTHER PUBLICATIONS

IBM Technical Disclosure Bulletin, Young, Display Device, 8-1963, vol. 6, No. 3.

*Primary Examiner*—John F. Pitrelli
*Attorney, Agent, or Firm*—Kurt Kelman

[57] ABSTRACT

A traffic sign selectively displays and obscures information arranged permanently on the outer surface of a rear plate of a pair of rigid, transparent plates defining a closed cavity therebetween by displacing out of and into the cavity an opaque liquid contained in a closed reservoir which has an air-filled space over the liquid. A closed fluid conduit system connects the cavity with the reservoir and includes a first valved conduit connecting the air-filled space to the cavity, a second valved conduit connecting the liquid to the reservoir, a pressure release valve in the first conduit, and a control for selectively delivering liquid from the reservoir into the cavity through the second conduit while concomitantly withdrawing air from the cavity through the first conduit, and vice versa, whereby the cavity is rapidly and completely filled with the liquid to obscure the information and emptied of the liquid to display the information. The information is illuminated from the rear.

6 Claims, 5 Drawing Figures

SWITCHABLE SIGN

Figure 1:
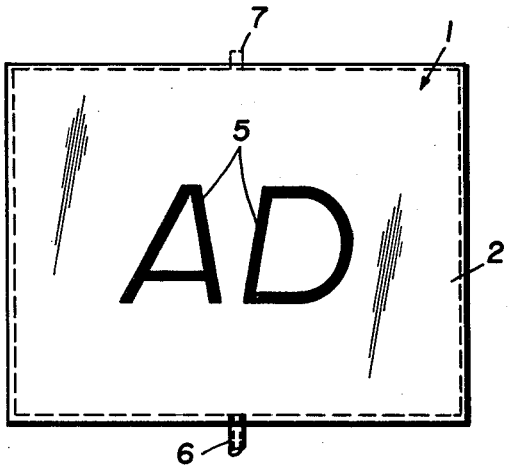

This is a continuation-in-part of our application Serial No. 629,068, filed Nov. 5, 1975, now abandoned.

The present invention relates to improvements in a sign for selectively displaying information to a viewer and obscuring the information from the viewer looking at the sign from one direction. The information may consist of an advertising message, a traffic message and any other type of intelligence, for instance in the form of symbols, letters or numbers.

In the use of signs, for example for directing traffic along certain lanes, i.e. at a toll barrier, conditions may require the display and dazzling of the sign at different times.

U.S. Pat. No. 1,782,328 discloses a sign display wherein a flexible diaphragm is mounted behind a window and defines a closed space therewith. Information is affixed to the front face of the diaphragm to be displayed through the window when the diaphragm is in contact therewith. A liquid may be pumped into the closed space to flex the diaphragm and fill the space with varying amounts of liquid to constitute a liquid screen through which the information is seen either in different colors, depending on the color of the liquid, different shapes, due to the flexing of the diaphragm, or even made invisible, if the liquid is opaque. Such a display sign would not be effective for the purpose of clearly displaying symbols such as traffic signs which must be sharply visible to the motorist without distortion or must be completely obscured. The flexible diaphragm carrying the information will create distortions of the displayed information when it is visible, clear visibility being difficult to accomplish because it requires the diaphragm to be pressed into contact with the window, which requires a high vacuum.

British Pat. No. 312,105 discloses a complex system controlled by a four-way tap selectively producing pressure and vacuum to fill and empty a chamber between two glass plates with a colored or opaque liquid for screening an illuminated object placed behind the chamber.

It is a primary object of this invention to provide a readily switchable sign capable of selectively sharply and clearly legibly displaying information applied to the rear face of the sign and to obscure this information from a viewer looking at the sign from the front.

It is a further object of the invention to provide such a sign with a simple and dependable operating mechanism for the effective display and dazzling of the information.

The above and other objects and advantages are accomplished in accordance with the present invention with a sign which comprises a pair of rigid and light-transmitting plates arranged parallel to each other and interconnected at respective edges thereof to define a closed cavity of constant volume between the inner, facing surfaces of the plates. The outer surface of the front plate faces the viewer and the outer surface of the rear plate faces in a direction opposite to the direction from which the viewer looks at the sign. The information is arranged permanently on the outer surface of the rear plate. A closed reservoir containing a liquid substantially impervious to the transmission of light and an air-filled space over the liquid is connected to the closed cavity by a closed fluid conduit system. This system includes a first valved conduit connecting the air-filled space to the cavity, a second valved conduit connecting the liquid to the cavity, a pressure release valve in the first conduit, and control means for selectively delivering liquid from the reservoir into the cavity through the second conduit while concomitantly withdrawing air from the cavity into the air-filled space through the first conduit, and delivering air from the space into the cavity through the first conduit while concomitantly withdrawing liquid from the cavity into the reservoir through the second conduit. In this manner, the cavity is rapidly and completely filled with the liquid to obscure the information and emptied of the liquid to display the information. A light source is mounted behind the rear plate for illuminating the information.

The closed, pressure-relieved conduit system assures perfect pressure balance in the closed cavity at all times so as to avoid undue pressure on the rigid plates, which could lead to distortions in viewing the information if the plates were deformed. This would make the sign useless for many purposes, such as traffic signs, where the information must be displayed sharply and clearly.

In this connection, it is also important that the liquid remain fluid under prevailing weather conditions and be displaceable readily into and out of the cavity without staining the transparent plates. According to a specific feature of this invention, this object is obtained with liquid petrolatum having a freezing point of −54° C. and having a fast and light-impervious dye homogeneously dissolved therein, an anti-static agent being preferably dispersed therethrough and the plates being of an acrylic resin. In such a system, the liquid can be rapidly pumped out of the cavity without leaving any stains.

Figure 2:
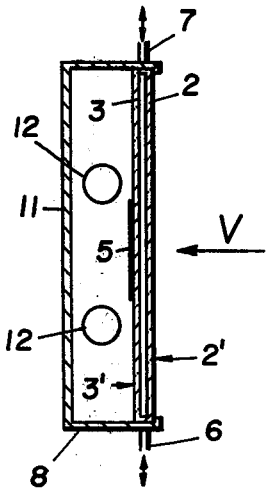
Figure 3:
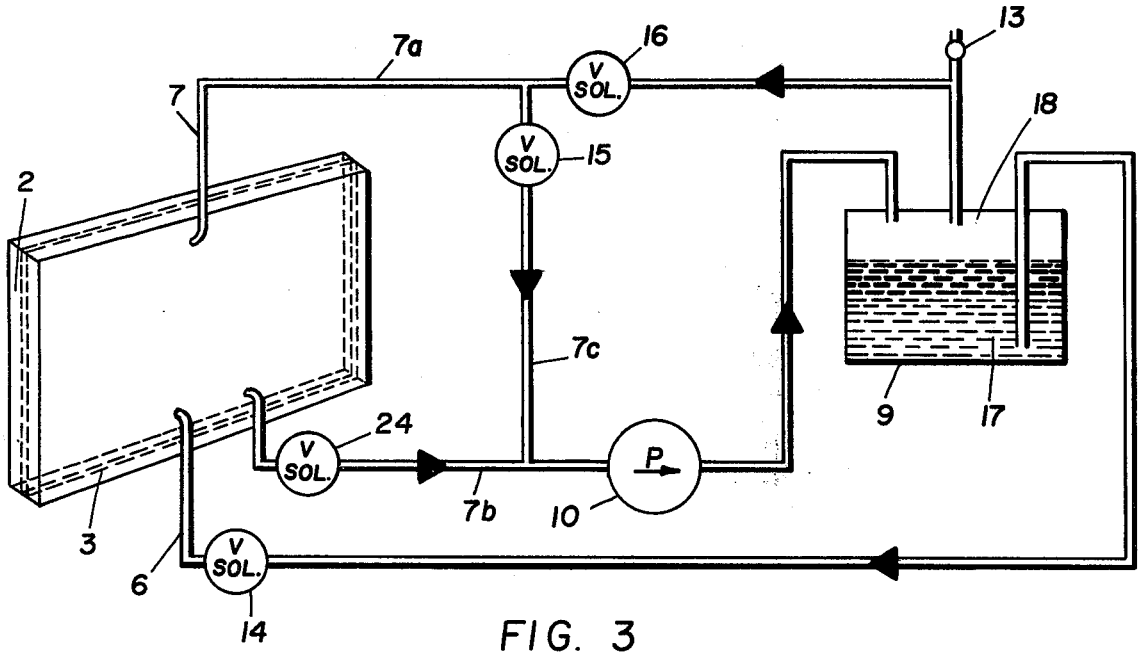
Figure 5:
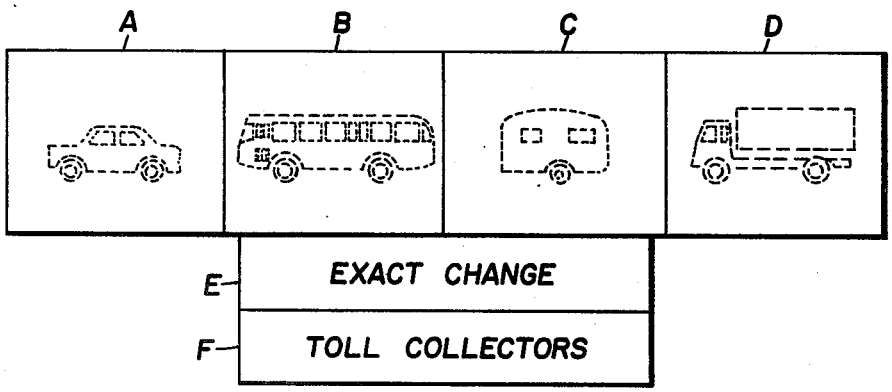
Figure 4:
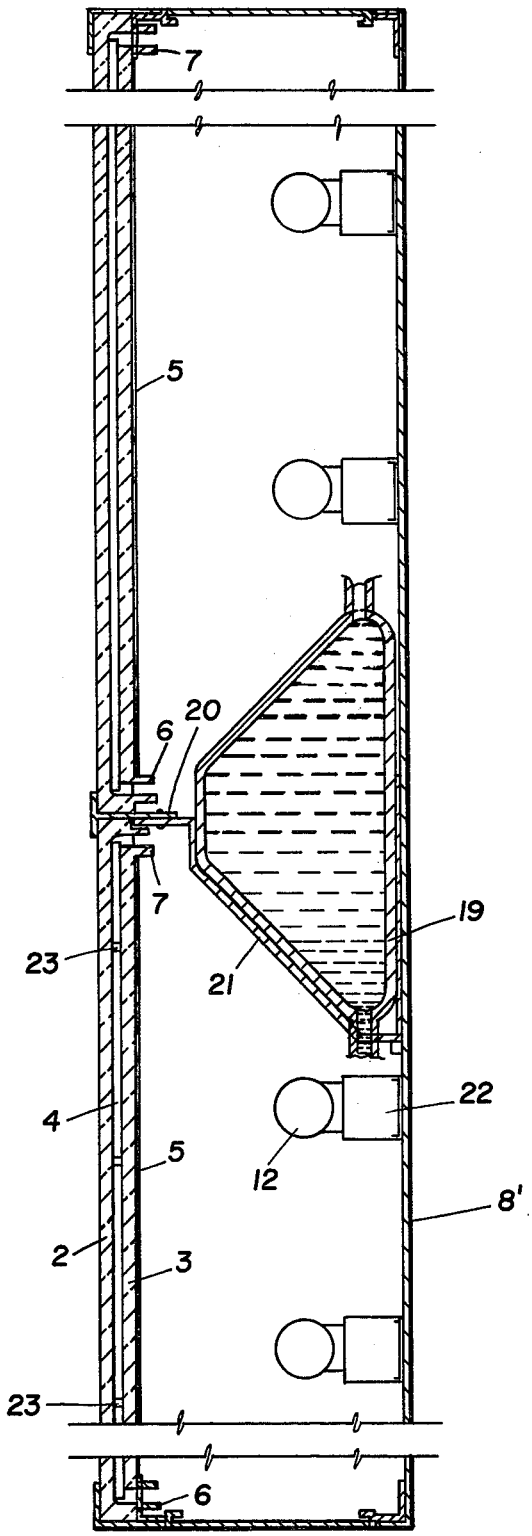

The above and other objects, advantages and features of the present invention will become more apparent from the following detailed description of certain now preferred embodiments thereof, taken in conjunction with the accompanying drawing wherein FIG. 1 is a schematic front elevational view of a sign according to this invention, the sign having been switched on to display the information;

FIG. 2 shows a vertical section of the sign of FIG. 1;

FIG. 3 schematically shows the liquid reservoir and the closed fluid conduit system for the sign of FIGS. 1 and 2;

FIG. 4 shows a vertical section of another embodiment of a sign according to the invention; and FIG. 5 is a schematic front elevational view of a traffic sign with a plurality of panels according to the embodiment of FIG. 4.

Referring now to the drawing and first to FIGS. 1 and 2, the illustrated sign panel 1 comprises a pair of rigid and transparent or light-transmitting plates 2 and 3 arranged parallel to each other and interconnected by end walls at respective edges thereof to define closed cavity 4 of constant volume between the inner, facing surface of the plates. The outer surface 2' of front plate 2 faces a viewer looking at the sign from one direction indicated by arrow V and the outer surface 3' of rear plate 3 faces in the opposite direction. Information 5 is arranged permanently on outer surface 3' of rear plate 3.

Information 5 may consist of any desired symbol, design and/or text conveying intelligence to the viewer, such as an advertising message or a traffic directing message. It is suitably applied to surface 3' in a selected dark color which is preferably translucent and of a color which provides contrast to a surrounding translucent contrast color applied to the transparent plates, and may be clearly legible, particularly when illuminated from behind.

While the rigid plates may be made of any suitable light-transmitting sheet material, we prefer transparent rigid sheets of acrylic resin, such as the well known "Plexiglas".

As shown in FIG. 2, a casing 8 may be attached to the pair of plates 2, 3 to form panel 1, casing 8 defining a chamber with rear plate 3. A light source comprised of a desired plurality of lamps 12 is mounted behind the rear plate in the chamber for illuminating information 5.

According to the present invention, information 5 is selectively displayed to a viewer (as shown in FIG. 1) and obscured from the viewer looking at the sign from the direction indicated by arrow V, the information being displayed when cavity 4 is empty, i.e. filled with air, and obscured when cavity 4 is filled with a liquid substantially impervious to the transmission of light, i.e. opaque. The liquid is of a dark color making the information totally invisible when the liquid fills cavity 4 and thus covers information 5 from the viewer.

A preferred embodiment of means for filling and emptying cavity 4 is illustrated schematically in FIG. 3. As shown therein, opaque liquid 17 is contained in closed reservoir 9 and air-filled space 18 is defined in the reservoir above the liquid level. A closed fluid conduit system connects closed cavity 4 defined by plates 2 and 3 with closed reservoir 9. This conduit system includes first valved conduit 7 connecting air-filled space 18 to cavity 4, second valved conduit 6 connecting liquid 17 to the cavity, and pressure release valve 13 in conduit 7 for adjusting the fluid pressure in the closed system in accordance with the prevailing atmospheric pressure. The pressure release valve has a very small air escape port so that it has no instantaneous effect but only operates over a long time period. A filter is mounted over the pressure relief valve to prevent dirt and dust from entering the closed conduit system from the surrounding atmosphere.

The invention provides control means for selectively delivering liquid 17 from reservoir 9 into cavity 4 through second conduit 6 while concomitantly withdrawing air from the cavity through first conduit 7 into air-filled space 18, and delivering air from the space into cavity 4 through the first conduit while concomitantly withdrawing liquid from the cavity into reservoir 9 through the second conduit. In this manner, the cavity is rapidly and completely filled with the liquid to obscure information 5 and emptied of the liquid to display the information.

The specifically illustrated control means comprises pump 10 in the fluid conduit system and the pump is reversible for selectively pumping liquid 17 into cavity 4 while concomitantly pumping air out of the cavity and pumping air into the cavity while concomitantly pumping liquid out of the cavity. Solenoid valve means in the conduit system is operable to open and close a respective one of the conduits for permitting the air and liquid to pass or to be retained.

The illustrated valve means consists of four solenoid valves 14, 15, 16 and 24. First valve 14 is mounted in second conduit 6. First conduit 7 includes first branch 7*a*, second branch 7*b* and by-pass 7*c* interconnecting branches 7*a* and 7*b*. Pump 10 is mounted in second branch 7*b* between by-pass 7*c* and air-filled space 18, second valve 24 is mounted in second branch 7*b* between the by-pass and cavity 4, third valve 15 is mounted in the by-pass, and fourth valve 16 is mounted in first branch 7*a* between by-pass 7*c* and air-filled space 18. The four solenoid valves are operable to be closed in a rest position wherein the cavity of the sign is filled with liquid, i.e. the information is obscured, or with air, i.e. when the cavity is empty to display information 5. As shown by the arrows, first valve 14 and third valve 15 are opened and pump 10 is started in a filling position wherein cavity 4 is to be filled with liquid and emptied of air while the second and fourth valves remain closed. In this filling cycle designed to obscure information 5, air is sucked out of the cavity by pump 10 through conduit branch 7*a* and by-pass 7*c* with valve 15 open, and pumped into space 18 through conduit branch 7*b*. The pumping will force liquid 17 to enter cavity 4 through conduit 6, with valve 14 open. In the emptying cycle designed to display the information, second valve 24 and fourth valve 16 are opened and, with the pump going and first and third valves remaining closed, liquid is pumped out of cavity 4 by pump 10 through conduit branch 7*b*, with valve 24 open, and delivered through space 18 into reservoir 9. Concomitantly, the pump will force air from the space to enter the cavity through conduit branch 7*a*, with valve 16 open. In this closed, pressure-relieved conduit system, pressure balance is assured in cavity 4 at all times, i.e. when the system is at rest as well as during the filling and emptying cycles. This perfect pressure balance avoids any undue pressure on plates 2 and 3 which could lead to distortions in viewing information 5 and thus make the sign useless for many purposes where the information must be displayed sharply and clearly.

The duration of both operating cycles is controlled in a well known manner by time relays connected in the control circuit for the solenoid valves and for actuation of the pump to provide for preset time cycles. Starting and stopping may be remotely controlled from an operating station by push-button controls. Such electric control systems are well known and form no part of the invention. Being readily available in commerce, they have not been described herein.

In many usages, such as in traffic signs, it is essential for the proper display and dazzling of the information that the cavity between the two rigid transparent plates be completely and rapidly emptied of liquid so as to show clearly or obscure fully the information on the sign. Thus, any residual adhesion between the opaque liquid and the inner surfaces of the plates 2 and 3 must be avoided. We have found that, with the use of acrylic resin plates, a thin liquid with a low freezing point will be released readily from the inner surfaces upon emptying of the cavity. A preferred liquid for this purpose has been found to be liquid petrolatum having a freezing point of −54° C. and having a fast and light-impervious dye homogeneously dissolved therein. Adherence of the liquid from the inner plate surfaces will be enhanced by the use of an anti-static agent, such as the commercially available anti-static agent "Norilon".

The dye used in the liquid must be completely and homogeneously soluble in the liquid, it must not settle in the liquid at low temperatures, and it must not color the inner surfaces of the plates, i.e. it must not migrate out of the liquid but remain fully dissolved therein under all operating conditions. The dyestuffs sold by the German company BASF under the trademark "Sudan" have been found very useful for this purpose. As much as 100 parts by weight of this dyestuff may be completely and homogeneously dissolved in 250 parts by weight of liquid petrolatum, our preferred liquid being a solution of about 60 grams of the dyestuff and 0.25 grams of "Norilon" per 30 liters of the petrolatum. A blue dyestuff designated "Sudan blue" has been successfully used in traffic signs and makes an opaque liquid which is, however, not entirely impervious to light. Sun light will not penetrate this liquid when it fills a cavity having a width of about 6 mm. Furthermore, the light source behind the information is preferably extinguished when the cavity is filled with liquid, the light source being controlled by the same control circuit which operates the pump and control valves in the manner described hereinabove, thus simultaneously turning on the lamps 12 when the pump is operated to deliver liquid to cavity 4. The thickness of the acrylic resin plates may be of the order of 10 mm.

Information 5 may be applied to the outer surface of rear plate 3 by a silk-screen process to etch the information into the plate surface and thus to achieve a very uniform quality of the print. Any desired color and/or symbol may be applied in this manner.

FIGS. 4 and 5 illustrate switchable traffic signs embodying the principles of the present invention described hereinabove and useful, for example, at bridge or other road toll barriers. A respective traffic sign, such as shown in FIG. 5, is placed over each lane of the toll to control traffic through the various lanes by operation of the signs in any desired manner. As shown in FIG. 5, every lane sign has six panels, each being constituted by a sign such as shown in FIGS. 1 and 2, and operable in accordance with the diagram of FIG. 3. Thus, each panel A, B, C, D, E and F is switchable to display either a bright, clear legend or a complete blank which is illegible under any lighting conditions. The four upper panels, A, B, C and D may have information symbolizing private cars in sign A, busses in sign B, trailers in sign C and trucks in sign D, for example, a respective one or respective ones of these signs being displayed or obscured to indicate whether the lane is open or closed to traffic by the respective types of vehicles. The lower panels may have information symbolizing whether the lane is an "exact change" lane or whether "toll collectors" are on duty.

A preferred structure of such a multiple-panel sign is shown in the sectional view of FIG. 4 which, in substance, simply duplicates the sign of FIG. 2, providing a common reservoir for all panels. This sign provides as many sets of pairs of rigid and light-transmitting plates 2, 3 as there are panels, the sets of plates being coplanar. Each of the sets or panels has a respective one of the closed conduit systems, as indicated by conduits 6 and 7, and light sources, as shown by light tubes 12. Common reservoir 19 is connected to closed cavity 4 of each set through the respective conduit systems.

As shown in FIG. 4, the sign panels are mounted in an aluminum casing 8' of which the panels form the front wall. A T-shaped aluminum profile 20 is inserted between the upper and lower panels and serves as support not only for the panels but also for aluminum bracket 21 which is affixed to profile 20 and to the rear wall of casing 8' to support reservoir 19 thereon. This locates the reservoir in the casing chamber. Armatures 22 of light tubes 12 are also mounted on the rear wall of the casing and located in the casing chamber.

If the surface area of the sign panel is large, possible distortion of rigid plates 2 and 3 under the liquid pressure in cavity 4 may be avoided by interconnecting the plates by a plurality of rigid pins 23. These pins are also of a light-transmitting material, preferably the same material as the plates. For instance, if the plates are of acrylic resin, registering holes are drilled through the rear plate and preferably only some distance into the front plate, and acrylic resin pins are inserted into the holes and fused to the plates to provide an integral double-walled structure reinforced by a plurality of connecting pins. To avoid stresses in the material as a result of fusing, the plates are heated to a temperature of about 75° C. to 76° C. and kept at this elevated temperature for at least about a day after fusing pins to the plates.

What we claim is:

1. A sign for selectively displaying information to a viewer and obscuring the information from the viewer looking at the sign from one direction, which comprises a. a pair of rigid and light-transmitting plates of an acrylic resin arranged parallel to each other and interconnected at respective edges thereof to define a closed cavity of constant volume between the inner, facing surfaces of the plates, the outer surface of a front one of the plates facing the viewer and the outer surface of a rear one of the plates facing in a direction opposite to the one direction, 1. the information being arranged permanently on the outer surface of the rear plate, b. a plurality of rigid pins interconnecting the facing surfaces of the plates, the pins being of light-transmitting material and supporting the plates against deformation, c. a closed reservoir containing a liquid substantially impervious to the transmission of light, the liquid being liquid petrolatum having a freezing point of −54° C., a fast and light-impervious dye homogeneously dissolved therein and an anti-static agent dispersed therethrough, and an air-filled space over the liquid, d. a closed fluid conduit system connecting the closed cavity and closed reservoir, the conduit system including 1. a first valved conduit connecting the air-filled space to the cavity,
2. a second valved conduit connecting the liquid to the cavity,
3. a pressure release valve in the first conduit, and
4. control means for selectively delivering liquid from the reservoir into the cavity through the second conduit while concomitantly withdrawing air from the cavity into the air-filled spaced through the first conduit, and delivering air from the space into the cavity through the first conduit while concomitantly withdrawing liquid from the cavity into the reservoir through the second conduit, whereby the cavity is rapidly and completely filled with the liquid to obscure the information and emptied of the liquid to display the information, and e. a light source mounted behind the rear plate in said one direction for illuminating the information.

2. The sign of claim 1, wherein the control means comprises a pump in the fluid conduit system, the pump being reversible for selectively pumping liquid into the cavity while concomitantly pumping air out of the cavity and pumping air into the cavity while concomitantly pumping liquid out of the cavity, and solenoid valve means in the fluid conduit system, the valve means being operable selectively to open and close a respective one of the conduits for permitting the air and liquid to pass or to be retained.

3. The sign of claim 2, wherein the valve means consists of four solenoid valves, a first one of the valves being mounted in the second conduit, the first conduit including a first branch, a second branch and a by-pass interconnecting the first and second branches, the pump is mounted in the second branch between the by-pass and the air-filled space, a second one of the valves is mounted in the second branch between the by-pass and the cavity, a third one of the valves is mounted in the by-pass, and a fourth one of the valves is mounted in the first branch between the by-pass and the air-filled space, the four valves being operable to be closed in a rest position wherein the cavity is filled with the liquid or with air, the first and third valves to be opened and the pump started in a filling position wherein the cavity is to be filled with liquid and emptied of air, while the second and fourth valves remain closed, and the second and fourth valves to be opened and the pump started in an emptying position wherein the cavity is to be filled with air and emptied of liquid, while the first and third valves remain closed.

4. The sign of claim 1, further comprising a casing attached to the pair of rigid plates and defining a chamber with the rear plate, means for mounting the reservoir in the casing chamber, and the conduit system and light source being arranged in the casing chamber.

5. The sign of claim 1, comprising more than one set of pairs of rigid plates, the sets being coplanar, each of the sets having a respective one of the conduit systems and light sources, and the reservoir being connected to the closed cavity of each set through the respective conduit systems.

6. The sign of claim 1, wherein the rigid pins are of the same acrylic resin as the plates, the plates and pins forming an integral double-walled structure reinforced by the pins.

* * * * *